US006311376B1

(12) United States Patent
Hinchliffe et al.

(10) Patent No.: US 6,311,376 B1
(45) Date of Patent: Nov. 6, 2001

(54) AIR JET

(75) Inventors: Malcolm Geoffrey Hinchliffe, Macclesfield; Gordon Stirling Rigg, Tideswell, both of (GB)

(73) Assignee: Fiberglass Limited (GB)

( * ) Notice: Subject to any disclaimer, the term of this patent is extended or adjusted under 35 U.S.C. 154(b) by 0 days.

(21) Appl. No.: 09/499,195

(22) Filed: Feb. 7, 2000

(30) Foreign Application Priority Data

Feb. 5, 1999 (GB) ..... 9902501

(51) Int. Cl.[7] ..... D02G 1/16; D02J 1/08
(52) U.S. Cl. ..... 28/272; 28/274
(58) Field of Search ..... 28/271, 272, 273, 28/274, 275, 276, 254; 57/279, 280, 289, 350, 333, 908

(56) References Cited

U.S. PATENT DOCUMENTS 4,547,938 * 10/1985 Cullen et al. ..... 28/272
4,560,347 * 12/1985 Runkel et al. ..... 28/272
4,829,640 * 5/1989 Greb et al. ..... 28/255
4,936,000 * 6/1990 Nabulon et al. ..... 28/272
4,941,242 * 7/1990 Nabulon ..... 28/255
4,953,271 * 9/1990 Wellenhofer et al. ..... 28/272
5,475,908 * 12/1995 Scherpf et al. ..... 28/272
5,475,909 * 12/1995 Heil et al. ..... 28/272
5,839,176 * 11/1998 Lin ..... 28/272
6,148,490 * 11/2000 Bertsch ..... 28/272

* cited by examiner

*Primary Examiner*—Amy B. Vanatta
(74) *Attorney, Agent, or Firm*—Schwegman, Lundberg, Woessner & Kluth, P.A.

(57) ABSTRACT

A relatively compact air jet is provided having a base and an operating part which is mounted on the base to rotate relative thereto to expose a yarn channel for threading. A straight air inlet through the base communicates with the yarn channel and has a valve member disposed within it. A connecting pin moved by a cam surface in the operating part acts on the valve member to open the air inlet when the operating part is in the operating position, but allows the air pressure on the valve member to close air inlet when the operating part is rotated to the threading position.

20 Claims, 2 Drawing Sheets

AIR JET

FIELD OF THE INVENTION

This invention relates to air jets as used in the textile industry for the purpose of intermingling filaments, twisting, texturing and combining textile yarns. Such jets usually have a channel running through the body of the jet through which the yarn or yarns travel to be subjected to the effect of a transversely directed jet of air.

BACKGROUND OF THE INVENTION

One of the problems associated with air jets of this type is that of threading the yarn or yarns through the yarn channel in the jet body. The original methods of threading using a needle or weight attached to the yarn were very time consuming and are not acceptable for modem high speed yarn processing machines. There are many jet designs which incorporate a threading slot communicating with the yarn channel over the length of the jet body, but such slots can impair the air flow in the yarn channel, create a tendency for the yarns to migrate into the slot, thereby preventing correct processing of the yarn, or even allow the yarn to escape from the jet. To avoid such problems, various arrangements have been devised for opening the jet to expose the yarn channel for access from the outside of the jet for yarn threading purposes and then for closing the jet to commence yarn processing. In one known type of jet, the yarn channel is in a central part of the jet body which is arranged to slide laterally relative to upper and lower parts, thereby exposing the channel and simultaneously closing the air inlet to the sliding central part to stop the flow of air into the yarn channel. This involves one surface sliding under pressure across a seal, which leads to rapid wear of the seal. Furthermore, the pivoted lever mechanism used to produce the sliding motion puts considerable stresses on the parts and in consequence is also prone to wear. Therefore, such an arrangement leads to high maintenance costs. In addition, this type of jet is very bulky and space for air jets in textile machines is restricted. Another type of opening air jet involves an upper part of the jet rotating relative to the lower part to expose the yarn channel in the lower part and simultaneously stop the flow of air through the lower part to the yarn channel. Such an arrangement has the serious disadvantage that the air inlet must be offset from the yarn channel in order that it can be closed by the rotated upper part when the channel is exposed for threading purposes, and in consequence during yarn processing the path of air from the inlet through the two parts of the jet to the yarn channel involves several changes of direction. This seriously reduces the air flow and its pressure when it reaches the yarn channel, thereby reducing the processing effectiveness of the air jet. Another problem is that exposing the yarn channel before the air is switched off and switching the air on whilst the yarn channel is still exposed can cause the yarn or at least some filaments to be blown out of the channel with the possibility of snagging on adjacent machine parts. In addition, maintaining satisfactory sealing of the resulting tortuous yam path through the two parts of the jet is difficult.

OBJECT OF THE INVENTION

It is an object of the present invention to provide an air jet which avoids, or at least reduces to an appreciable extent, the disadvantages of the known air jets.

SUMMARY OF THE INVENTION

The invention provides an air jet having a base and an operating part, the base having a yarn channel therein and an air inlet communicating with the yarn channel, the operating part being movable relative to the base between an operating position in which the operating part covers the yarn channel and a threading position in which the yarn channel is exposed, comprising a valve member disposed in the air inlet and a connecting part connecting the valve member and the operating part whereby movement of the operating part between the operating position and the threading position causes the valve member to open and close the air inlet.

Preferably the axis of the air inlet intersects the longitudinal axis of the yarn channel. The axis of the air inlet may be inclined to the longitudinal direction of the yarn channel at an angle of between 70° and 90°, preferably substantially 80° in the direction of travel of a yarn through the yarn channel.

The air inlet may comprise a connecting bore and a counterbore having a larger diameter than that of the connecting bore. The connecting bore may communicate with the yarn channel and the counterbore may be adapted to receive an air supply connector. The valve member may comprise a valve head located in the counterbore and adapted to seal the air inlet at the transition from the counterbore to the connecting bore. The valve member may also comprise an arm disposed in the base so as to be movable therein, having the valve head at one end thereof. The connecting part may comprise a pin located in the base to have one end thereof in contact with the arm and the other end in contact with a cam surface provided on the operating part. The cam surface may be positioned whereby the valve member closes the air inlet prior to the operating part moving sufficiently to expose the yarn channel.

The operating part may be mounted on the base to rotate relative thereto, and may rotate about an axis which is offset from and substantially perpendicular to the yarn channel. The valve member may dose the air inlet when the operating part has rotated through 30° from the operating position, and may fully open the air inlet when the operating part has rotated to within 10° of the operating position. A stop arrangement may be provided to limit the rotation of the operating part to substantially 90°. The stop arrangement may comprise an upstanding wall on the base with which the operating part is in contact when the operating part is in the operating or threading position. One of two substantially mutually perpendicular sides of the operating part may be in contact with the wall when the operating part is in the operating or threading position. The operating part may comprise a handle portion. The operating part may be resiliently biased towards the base.

BRIEF DESCRIPTION OF THE DRAWINGS

One embodiment of the invention will now be further described with reference to the accompanying drawings in which.

DESCRIPTION OF THE PREFERRED EMBODIMENTS

Figure 1:
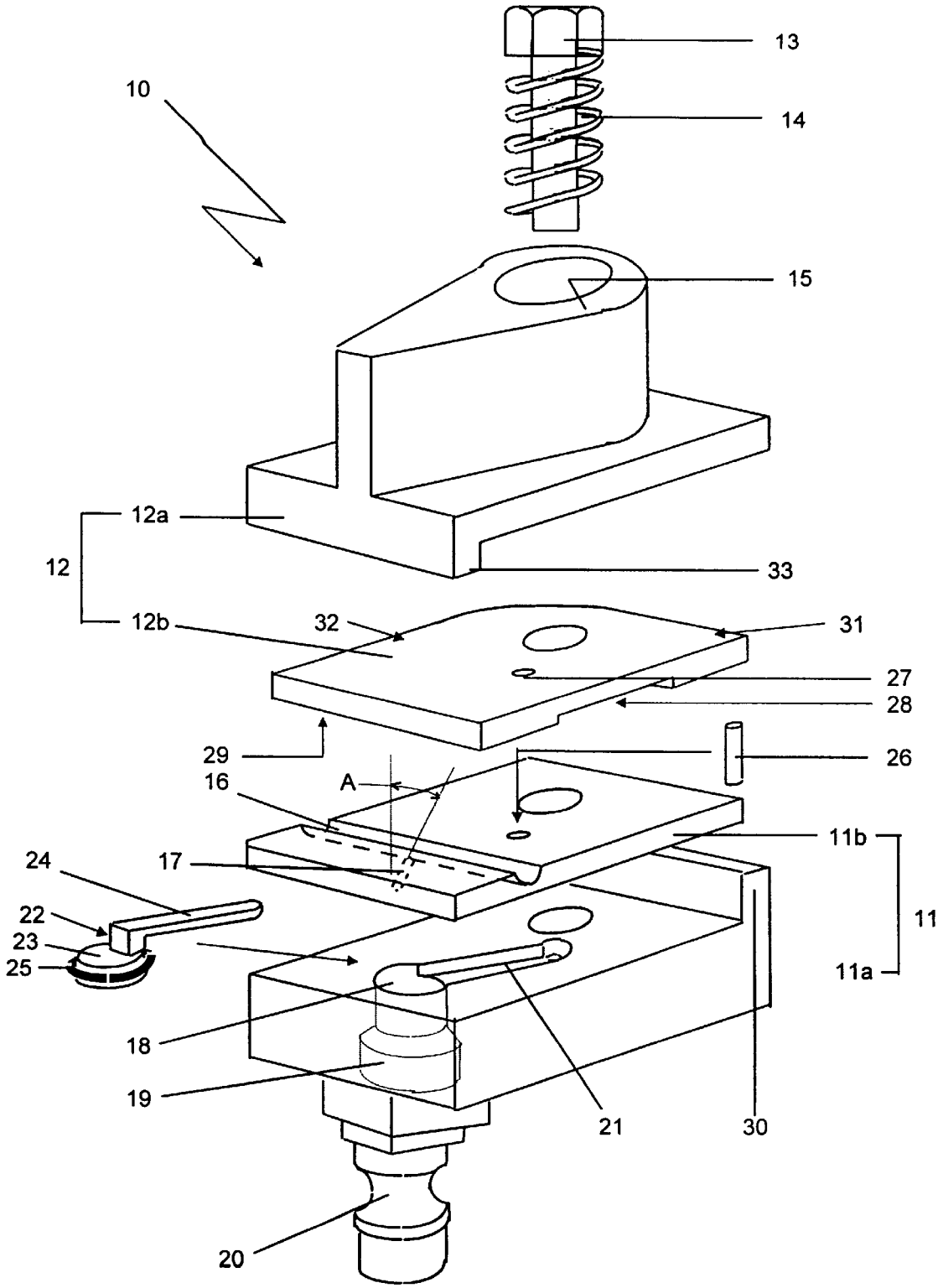
FIG. 1 is an exploded view of an air jet in the operating configuration.

Referring now to FIG. 1, there is shown an air jet 10 for the purpose of intermingling filaments, twisting, texturing or combining textile yarns. The air jet 10 comprises a base 11, consisting of a base block 11*a* and a base plate 11*b*, and an operating part 12, consisting of a handle part 12*a* and a top plate 12*b*. Base block 11*a* and handle part 12*a* may be made of aluminium alloy, brass or plastics material. Base plate 11*b* and top plate 12*b*, which in use are mutually in contact and slide relative to each other, may be made of stainless steel, carbide, alumina or ceramic material for wear resistance. A screw 13, on which is a spring 14, fits into a bore 15 in the handle part 12*a* to secure the parts 12*a*, 12*b*, 11*b* and 11*a* together. The spring 14, compressed between the head of the screw 13 and the base of the bore 15, ensures that the required pressure is maintained between the top plate 12*b* and the base plate 11*b*, whilst allowing relative movement between the operating part 12 and the base 11.

Extending across the base plate 11*b* is a yarn channel 16. A small bore 17 intersects the yarn channel 16 coaxially to provide an air inlet to the channel 16, and the bore 17 is inclined to the longitudinal direction of the yarn channel 16 by an angle A to assist in forwarding the yarn through the channel 16. The angle A may be between 0° and 20°, preferably substantially 10°. The bore 17 communicates with a connecting bore 18 in the base block 11*a*, which in turn communicates with a counterbore 19 having a larger diameter than that of the connecting bore 18. The bores 17, 18 and 19 are all in axial alignment with the yarn channel 16 so that the air travels along a relatively straight path through the base 11. An air supply connector 20 is received in the counterbore 19.

Also opening into the connecting bore 18 is a groove 21 formed in the base block 11*a*. Received in the groove 21 and the bores 18, 19 is a valve member 22 formed with a valve head 23 and an arm 24. The valve head 23 is disposed in the counterbore 19 and the arm 24 extends along the groove 21. Around the valve head 23 is an O-ring seal 25. A pin 26 is located in a bore 27 in the base plate 11*b*, the bottom of the pin 26 being in contact with the arm 24 as it extends along the groove 21. The top of the pin 26 is either received in a recess 28 formed in the underside 29 of the top plate 12*b* or is in contact with that underside 29, depending upon the position of the operating part 12 relative to the base 11, as is described below.

An upstanding wall 30 is provided at the rear of the base block 11*a* to provide a stop to limit the rotational motion of the operating part 12 relative to the base 11. Edge 31 of the top plate 12*b* is in contact with the wall 30 when the operating part 12 is in the operating configuration, and edge 32 of the top plate 12*b* is in contact with the wall 30 when the operating part 12 is in the threading configuration.

Figure 2:
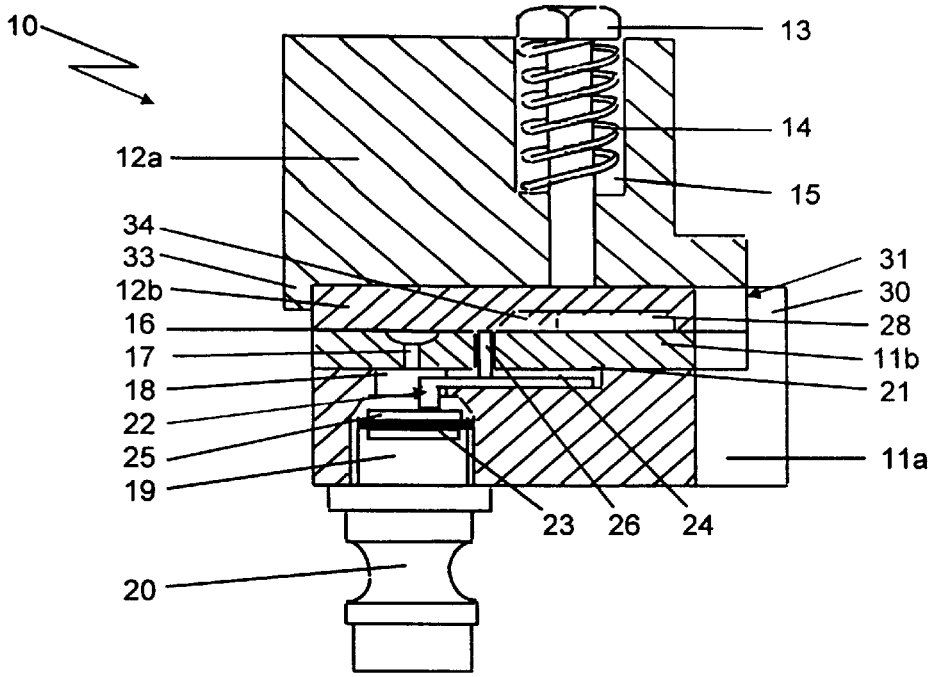
FIG. 2 is a dual sectional view of the jet in the operating configuration.
Figure 3:
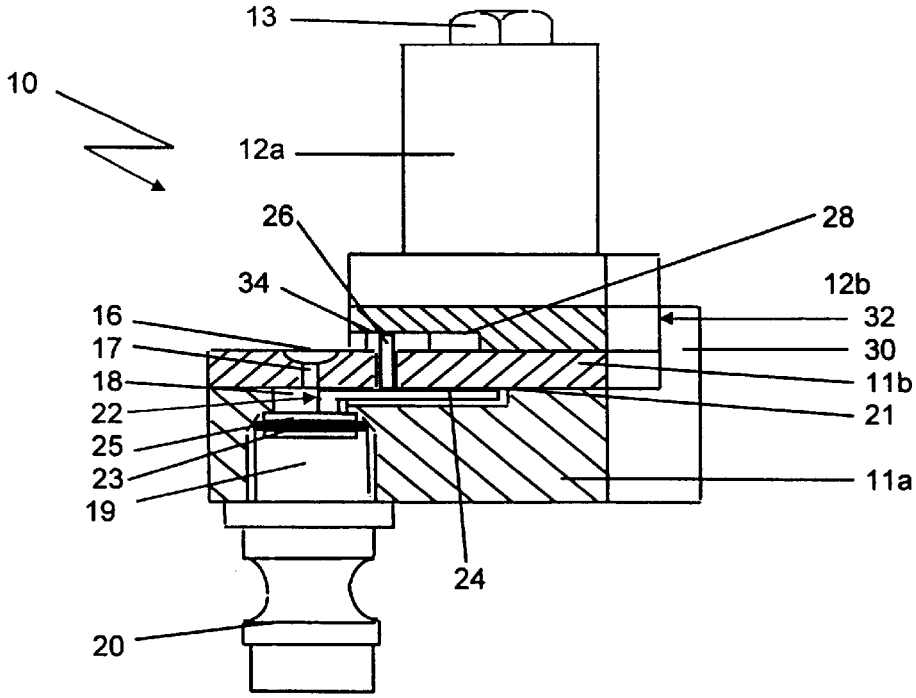
FIG. 3 is a part sectional view of the jet in threading configuration

Operation of the air jet 10 will be more clearly understood by consideration of FIGS. 2 and 3. In FIG. 2, the air jet 10 is in the operating configuration. In this configuration the top plate 12*b* covers the yarn channel 16. The underside 29 of the top plate 11*b* pushes downwardly on the pin 26 which in turn pushes downwardly on the arm 24. This pressure causes the valve head 23 to move away from the lower end of the connecting bore 18, thereby allowing air to pass from the air inlet connector 20, around the valve head 23 and subsequently through the bores 18 and 17 to the yarn channel 16.

For threading, the handle part 12*a* is rotated through 90°, about the axis of the screw 13 which is offset from and perpendicular to the yarn channel 16, to the threading configuration shown in FIG. 3. When this occurs, a lip 33 on the handle part 12*a* ensures that the top plate 12*b* moves with the handle part 12*a*. The yarn channel 16 is thereby exposed to allow access from outside the air jet 10 for laying the yarn or yarns into the channel 16. At the same time, the movement of the operating part 12 allows the pin 26 to ride up an inclined cam surface 34 to be received in the recess 28 in the top plate 12*b*. The pressure of the air on the valve head 23 forces the valve member 22 to rise, so that the arm 24 pushes the pin 26 upwardly into the recess 28. This movement of the valve member 22 brings the sealing ring 25 into sealing engagement with the transition region between the counterbore 19 and the connecting bore 18, thereby stopping the air flow from the air inlet connector 20 to the yarn channel 16. On returning the handle part 12*a* to the operating position shown in FIG. 2, the inclined cam surface 34 pushes the pin 26 and the valve member 22 downwardly again thereby opening the air gap around the valve head 23.

The position of the cam surface 34 is such that the pin 26 rides up the cam surface 34 and reaches the bottom of the recess 28 in the top plate 12*b* within 30° of rotation of the operating part 12 from the operating position shown in FIG. 2. This avoids the problem of the yarn being blown out of the yarn channel 16 since the channel 16 is only exposed when the valve head 23 is in contact with the lower end of the connecting bore 18 and the air is switched off. Similarly, to ensure correct operation of the air jet 10 even if the operating part 12 is not fully moved to the operating position, the pin 26 rides down the cam surface 34 onto the bottom surface 29 of the top plate 12*b* to switch the air fully on when the operating part 12 is within 10° of the operating position.

By means of the invention a relatively compact air jet is provided which has many advantages over the known air jets. Movement of the operating part does not involve sliding of one part of the jet over a seal and does not introduce significant stresses on the parts of the jet, thereby reducing the wear and maintenance of the jet. Also the path of the air through the air jet is substantially straight so that no sealing problems arise and there is no loss of air flow or pressure at the yarn channel. Other embodiments of air jet in accordance with the invention will be readily apparent to persons skilled in the art. For example, the motion of the operating part relative to the base may be linear, such as along slides, instead of rotational, without introducing the problems of the known sliding arrangement. The configuration of the valve member 22, connecting bore 18 and counterbore 19 may differ from that described above, e.g. the connecting bore 18 may be dispensed with and valve head 23 may seal with its upper surface against the underside of the base plate 11*b* instead of the connecting bore/counterbore interface as described above. Alternatively, the connecting bore 18 may be of larger diameter than the counterbore 19 so that the air pressure opens the valve member 22 upwardly when the operating part 12 is in the operating configuration and the motion of the operating part 12 to the threading configuration closes the valve member 22 downwardly instead of the reverse arrangement described above.

What is claimed is:

1. An air jet having a base and an operating part, the base having a yarn channel therein and an air inlet having a sealing surface and communicating with the yarn channel, the operating part being movable relative to the base between an operating position in which the operating part covers the yarn channel and a threading position in which the yarn channel is exposed; comprising a valve member disposed in the air inlet and a connecting part connecting the valve member and the operating part whereby movement of the operating part between the operating position and the threading position causes the valve member to move into and out of contact with the sealing surface to open and close the air inlet.

2. An air jet according to claim 1, wherein the axis of the air inlet intersects the longitudinal axis of the yarn channel.

3. An air jet according to claim 2, wherein the axis of the air inlet is inclined to the longitudinal direction of the yarn channel.

4. An air jet according to claim 3, wherein the axis of the air inlet is inclined at an angle of between 70° and 90° to the direction of travel of a yarn through the yarn channel.

5. An air jet according to claim 1, wherein the air inlet comprises a connecting bore and a counterbore having a larger diameter than that of the connecting bore.

6. An air jet according to claim 5, wherein the connecting bore communicates with the yarn channel.

7. An air jet according to claim 1, wherein the operating part is mounted on the base to rotate relative thereto.

8. An air jet according to claim 7, wherein the valve member closes the air inlet when the operating part has rotated through substantially 30° from the operating position.

9. An air jet according to claim 7, wherein the valve member fully opens the air inlet when the operating part has rotated to within 10° of the operating position.

10. An air jet according to claim 7, wherein a stop arrangement is provided to limit the rotation of the operating part to substantially 90°.

11. An air jet according to claim 10, wherein the stop arrangement comprises an upstanding wall on the base with which the operating part is in contact when the operating part is in the operating or threading position.

12. An air jet according to claim 1, wherein the operating part is resiliently biased towards the base.

13. An air jet according to claim 1, wherein the operating part comprises a handle portion.

14. An air jet having a base and an operating part, the base having a yarn channel therein and an air inlet communicating with the yarn channel, the operating part being movable relative to the base between an operating position in which the operating part covers the yarn channel and a threading position in which the yarn channel is exposed; comprising a valve member disposed in the air inlet and a connecting part connecting the valve member and the operating part whereby movement of the operating part between the operating position and the threading position causes the valve member to open and close the air inlet, comprising a transition region between the connecting bore and the counterbore, wherein the valve member comprises a valve head located in the counterbore and adapted to seal the air inlet at the transition region, wherein the air inlet comprises a connecting bore and a counterbore having a larger diameter than that of the connecting bore.

15. An air jet according to claim 14, wherein the valve member comprises an arm disposed in the base so as to be movable therein.

16. An air jet according to claim 15, wherein the arm has ends and has a valve head at one end thereof.

17. An air jet according to claim 15, wherein the connecting part comprises a pin having two ends and located in the base to have one end thereof in contact with the arm and the other end in contact with a cam surface provided on the operating part.

18. An air jet according to claim 17, wherein the cam surface is positioned whereby the valve member closes the air inlet prior to the operating part moving sufficiently to expose the yarn channel.

19. An air jet having a base and an operating part, the base having a yarn channel therein and an air inlet communicating with the yarn channel, the operating part being movable relative to the base between an operating position in which the operating part covers the yarn channel and a threading position in which the yarn channel is exposed; comprising a valve member disposed in the air inlet and a connecting part connecting the valve member and the operating part whereby movement of the operating part between the operating position and the threading position causes the valve member to open and close the air inlet, wherein the operating part is mounted on the base to rotate relative thereto and wherein the operating part is mounted to rotate about an axis which is offset from and substantially perpendicular to the yarn channel.

20. An air jet having a base and an operating part, the base having a yarn channel therein and an air inlet communicating with the yarn channel, the operating part being movable relative to the base between an operating position in which the operating part covers the yarn channel and a threading position in which the yarn channel is exposed; comprising a valve member disposed in the air inlet and a connecting part connecting the valve member and the operating part whereby movement of the operating part between the operating position and the threading position causes the valve member to open and close the air inlet, wherein the operating part is mounted on the base to rotate relative thereto, wherein a stop arrangement is provided to limit the rotation of the operating part to substantially 90°, wherein the stop arrangement comprises an upstanding wall on the base with which the operating Dart is in contact when the operating part is in the operating or threading position, wherein the operating part has two substantially mutually perpendicular sides, one of which sides is in contact with the wall when the operating part is in the operating position and the other of which sides is in contact with the wall when the operating part is in the threading position.

* * * * *

UNITED STATES PATENT AND TRADEMARK OFFICE

CERTIFICATE OF CORRECTION

PATENT NO. : 6,311,376 B1 
DATED : November 6, 2001
INVENTOR(S) : Malcolm Geoffrey Hinchliffe and Gordon S. Rigg It is certified that error appears in the above-identified patent and that said Letters Patent is hereby corrected as shown below:

Title page,
Item [73], under "Assignee", delete "Fiberglass" and insert -- Fibreguide --, therefor.

Column 6,
Line 43, delete "Dart" and insert -- part --, therefor.

Signed and Sealed this

Thirteenth Day of August, 2002

*Attest:*

JAMES E. ROGAN
*Director of the United States Patent and Trademark Office*

*Attesting Officer*